United States Patent [19]

Laarman

[11] Patent Number: 5,022,623

[45] Date of Patent: Jun. 11, 1991

[54] HANGING DEVICE FOR BRICK WALLS

[76] Inventor: Christopher J. Laarman, 1022 S.W. 11th St., Corvallis, Oreg. 97333

[21] Appl. No.: 617,664

[22] Filed: Nov. 23, 1990

[51] Int. Cl.[5] ..... F16M 13/00

[52] U.S. Cl. ..... 248/231.9; 52/27; 52/698; 403/373

[58] Field of Search ..... 248/231.9, 231.91, 231.2, 248/297.2; 403/373; 52/441, 699, 698, 712, 481, 38, 27, 422, 489, 707

[56] References Cited

U.S. PATENT DOCUMENTS

| | | | |
|---|---|---|---|
| 3,289,373 | 12/1966 | Miller | 52/698 X |
| 4,037,384 | 7/1977 | Molyneux | 52/698 |
| 4,145,840 | 3/1979 | Davidson | 248/231.2 X |
| 4,823,709 | 4/1989 | Tesney | 248/231.2 X |
| 4,872,629 | 10/1989 | Cothran et al. | 248/231.91 X |

*Primary Examiner*—David L. Talbott
*Attorney, Agent, or Firm*—John F. Ingman

[57] ABSTRACT

A hanging device for brick walls includes a plate member having a mortar line contacting edge, termed the base, and at least two threaded holes formed therein which are of unequal distance from the base. Two elongated threaded members, inserted through the holes, and the base of the plate member combine to engage a raked mortar joint of the brick wall. The base of the plate member contacts the upper mortar line between the mortar face and the upper brick of the mortar joint. A first elongated threaded member is inserted through a threaded hole which is closer to the base and proximate the lower outer edge of the upper brick. The second elongated threaded member is inserted through a threaded hole in the plate member which is further from the base, so as to contact the upper surface of the lower brick within the mortar joint crevice. Continued insertion of the second elongated threaded member pivots the base of the plate member at the upper mortar line so that an intermediate location on the side of the first elongated threaded member is forced against the lower outer edge of the upper brick, thereby locking the hanging device securely within the raked mortar joint. The object to be hung is then suspended from an outwardly extending threaded member. A plurality of holes, seven in the preferred embodiment, in the plate member may be utilized to provide a variety of elongated threaded member positions for use with various heights and depths of mortar joint.

12 Claims, 1 Drawing Sheet

HANGING DEVICE FOR BRICK WALLS

BACKGROUND OF THE INVENTION

1. Field of the Invention

The present invention involves a device to support objects hanging from walls, and, more particularly, a hanging device for brick walls.

2. Description of the Prior Art

The hanging of objects, such as pictures, plants, Christmas decorations, or similar items, from interior brick walls and fireplaces, or from exterior brick walls or external chimneys, generally has required the use of a drill, with masonary bit, to form a suitable hole in the brick or mortar, the insertion of a molley into this hole, and finally the insertion of a screw or lag bolt to provide the projection upon which the object is hung. This procedure is time consuming, utilizes tools which may not be commonly available, and mars the surface of the brick wall, making it undesirable to remove such hangers and establish new hanging locations.

There is a need for a hanging device for brick walls which is simple and inexpensive, easily installed with common tools, and does not mar the wall nor leave a hole upon its removal.

SUMMARY OF THE INVENTION

The present invention provides a hanging device for brick walls which is designed to satisfy the aforementioned need. The invention includes a plate member having a mortar line contacting edge and having at least two threaded holes formed therein which are of unequal distance from that edge. Two elongated threaded members, inserted through the holes, and the mortar line contacting edge of the plate member engage a raked mortar joint of the brick wall to form a secure hanging device.

Accordingly, in the preferred embodiment, the plate member has at least one straight edge, termed the base, which edge contacts the upper mortar line between the mortar face and the upper brick of the mortar joint. A first, and preferably longer, elongated threaded member is inserted through a threaded hole which is closer to the base and proximate :he lower outer edge of the upper brick. The second, and preferably shorter, elongated threaded member is inserted through a threaded hole in the plate member which is further from the base, so as to contact the upper surface of the Lower brick within the mortar joint crevice. Continued insertion of the second elongated threaded member pivots the base of the plate member at the upper mortar line so that an intermediate location on the side of the first elongated threaded member is forced against the lower outer edge of the upper brick, thereby locking the hanging device securely within the raked mortar joint. The object to be hung is then suspended from the outwardly extending first elongated threaded member.

A plurality of holes, seven in the preferred embodiment, in the plate member may be utilized to provide a variety of elongated threaded member positions for use with various heights and depths of mortar joint. With the base of the plate member being placed along the upper mortar line, the threaded holes in the plate member generally extend downward from the base. Such holes, however, need not be in a single line, but rather may be staggered, such staggering allowing for a greater number of holes and more flexibility in adjustment of the hanging device for brick walls.

DESCRIPTION OF THE PREFERRED EMBODIMENT

Figure 1:
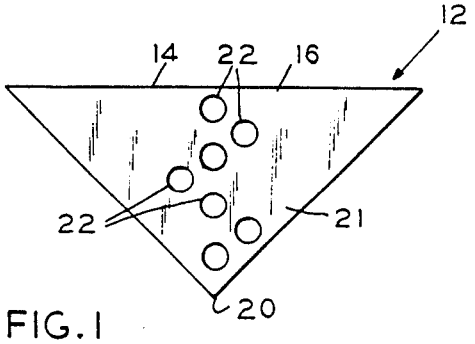
FIG. 1 illustrates a plan view of a preferred plate member of the hanger device for brick walls.

Turning now to the drawings, there is shown in FIG. 1 a front view of a preferred plate member 12 of the hanger device for brick walls 10. The plate member 12 has a mortar line contacting edge 14, preferably in the form of a straight edge for broad uniform contact with a mortar line 48, which edge 14 may for convenience be termed the base 16.

The preferred overall shape, as illustrated, is an isosceles right triangle 21 where the apex 20, opposing the base 16, is the right angle. Such shape is preferred primarily due to ease and economy of manufacture. Other shapes also could be used, a semi-circle (not shown) having the advantage of not having the pointed apex 20.

At least two holes 22 are formed in plate member 12 at different distances from the base 16. While two holes 22 are all that is used for a particular installation of the hanging device 10, it is generally desirable to have a number of holes 22 spaced between the base 16 and apex 20, as may conveniently be formed. In the preferred embodiment illustrated, where the plate member 12 has a length of base 16 of 2-inches and a height of 1-inch between the base 16 and the apex 20, and where the holes 22 are 7/64-inches in diameter, it has been found convenient to have a staggered series of seven (7) holes as illustrated. The staggering of the holes 22 has no detrimental unbalancing effect as long as they generally extend between the base 16 to the apex 20. As discussed subsequently, the variety of hole 22 locations gives greater flexibility in choosing the best position for the elongated threaded members 24, 26 to penetrate the plate member 12 to accomodate a variety of widths 28 and depths 30 of mortar joints 32.

The preferred plate member 12 is constructed of 1/16-inch steel plate with the holes 22 pre-tapped. If constructed of plastic, it may be desirable to utilize elongated threaded members 24, 26 which are of the self-tapping variety.

Figure 2:
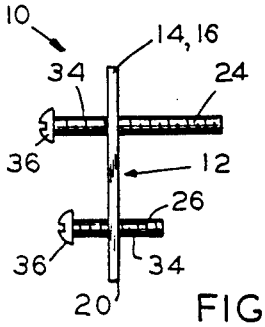
FIG. 2 illustrates a side view of the plate member of FIG. 1, wherein first and second threaded fastening members have been inserted in upper and lower holes respectively.

FIG. 2 illustrates the preferred plate member 12 of FIG. 1 in side view, where two elongated threaded members 24 and 26 have been inserted in two holes 22. A preferred form of the elongated threaded members 24, 26 is a common machine screw 34 with slotted head 36, which is preferred because of its low cost and the common household availability of a blade screwdriver or equivalent.

The first elongated threaded member 24, preferably the Longer of the two elongated threaded members 24, 26, is inserted through a threaded hole 22 in the plate member 12 which is closer to the base 16, while the second, and shorter, elongated threaded member 26 is inserted closer to the apex 20.

The hanging device for brick walls 10 is designed for use in combination with a brick wall 38 wherein bricks 40 or the like are vertically separated by a layer of masonary cement or mortar 42, termed a mortar joint 32. Commonly such mortar joint 32 has both a width 28 between adjacent bricks 40, of from ⅜-inch to ⅝-inch. In order to provide a decorative appearance, the face 44 of the mortar joint 32 normally is recessed from the front face 46 of the bricks 40 a depth 30 of from ⅜-inch to ⅝-inch, to form a crevice having such recessed mortar joint 32, commonly being termed a raked joint.

Figure 3:
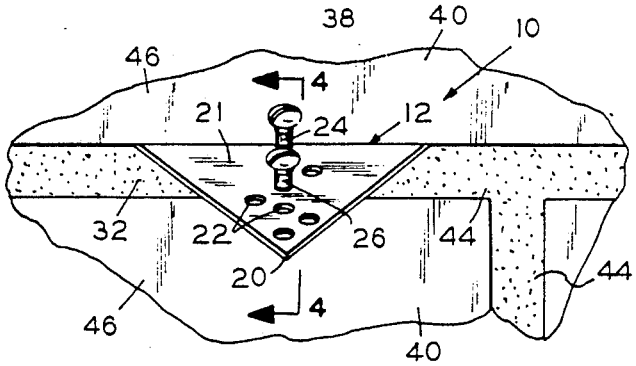
FIG. 3 illustrates a front view of the hanger device for as installed in a raked mortar joint.
Figure 4:
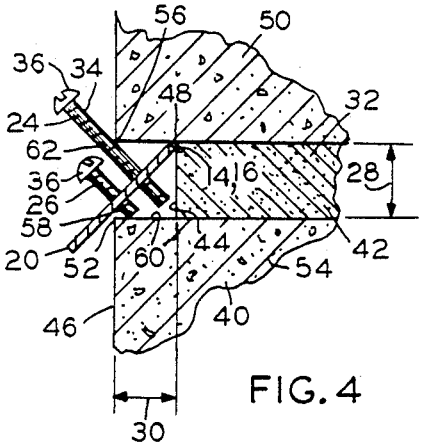
FIG. 4 illustrates a side view of the installed device as 3.

In FIGS. 3 and 4 there is shown the hanger device for brick walls 10 as installed in a raked mortar joint 32. The base 16 of the plate member 12 is placed along and against the upper mortar line 48 between the mortar face 44 and the upper brick 50. The remainder of the plate member 12 extends outward and downward therefrom, over the upper outer edge 52 of the lower brick 54. The first and longer elongated threaded member 24 is inserted through the plate member 12, near the outer edge 56 of the upper brick 50. The second and shorter elongated threaded member 26 is then inserted so that its end 58 contacts the upper exposed surface 60 of the lower brick 54. Continued insertion of the second elongated threaded member 26 serves to upwardly pivot the plate member 12 about its base 16 at the upper mortar line 48, thereby forcing the first elongated threaded member 24, at an intermediate location 62, against the lower outer edge 56 of the upper brick 50.

The hanging device for brick walls 10 thus becomes securely locked in place at the mortar joint 32 with pressured contact against the upper mortar line 48, the upper exposed surface 60 of the lower brick 54, and the lower outer edge 56 of the upper brick 50. The object to be hung (not shown) is then suspended from the extending first elongated threaded member 24.

Figure 5:
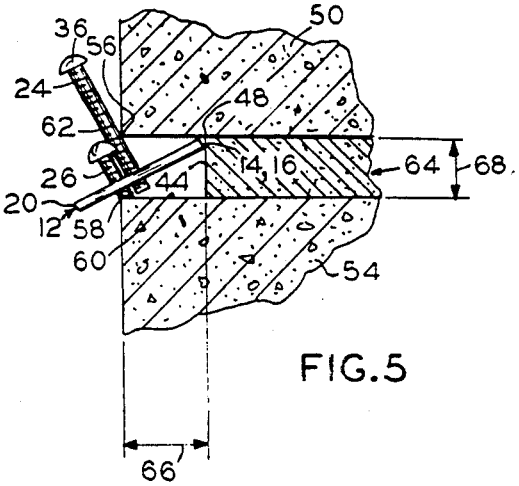
FIG. 5 illustrates a side view of the device as installed in an alternatively shaped raked mortar joint.
Figure 6:
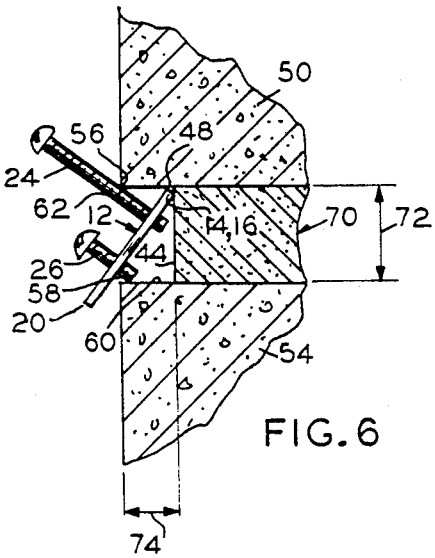
FIG. 6 illustrates a side view of the device as installed in a second alternatively shaped raked mortar joint.

FIG. 4 illustrates a raked mortar joint 32 wherein the width 28 and depth 30 are essentially equal at approximately ½-inch. FIG. 5 illustrates an alternatively formed mortar joint 64 wherein the depth 66 is significantly greater than the width 68, such as a depth 66 of ⅝-inch and a width 68 of ⅜-inch. FIG. 6 illustrates a second alternatively formed mortar joint 70 having a width 72 significantly greater than the depth 74, such as a width 72 of ⅝-inch and a depth 74 of ⅜-inch. As readily may be seen from comparison of FIGS. 4, 5, and 6, the preferred locations of the elongated threaded members 24, 26 will vary considerably, both in relation to the plate member 12 and to each other. For any mortar joint of specific dimensions only two appropriately placed holes 22 within the plate member are needed. However, for a hanging device for brick walls 10 which is adaptable to a variety of different mortar joints, it is desirable to have a number of holes 22, as described previously, within the plate member.

It is thought that the hanging device for brick walls of the present invention and its many attendant advantages will be understood from the foregoing description and that it will be apparent that various changes may be made in form, construction and arrangement of the parts thereof without departing from the spirit and scope of the invention or sacrificing all of its material advantages, the forms hereinbefore stated being merely exemplary embodiments thereof.

I claim:

1. A hanging device, in combination with a brick wall or the like having a recessed mortar joint, wherein, within a crevice thus formed, an upper brick adjoins mortar at an upper mortar line, the hanging device comprising:

a. a plate member having an upper mortar line contacting edge and at least two holes formed at different distances from said upper mortar line contacting edge of the plate member;

b. a first elongated member formed to threadingly engage one said hole which is formed more closely to said upper mortar line contacting edge of the plate member;

c. a second elongated member formed to threadingly engage another said hole which is formed more distantly from said upper mortar line contacting edge of the plate member.

2. The hanging device, as recited in claim 1, wherein said hole formed more closely to said upper mortar contacting edge is positioned so that said first elongated member when inserted therethrough will be proximate an outer lower edge of said upper brick.

3. The hanging device, as recited in claim 1, wherein said hole formed more distantly from said upper mortar contacting edge is positioned so that said second elongated member when inserted therethrough will contact an exposed portion of the lower brick within the crevice.

4. The hanging device, as recited in claim 1, wherein the first elongated member is of greater length than said second elongated member.

5. The hanging device, as recited in claim 4, wherein an object to be supported is suspended from said first elongated member.

6. The hanging device, as recited in claim 1, wherein the first and second elongated members are machine screws.

7. The hanging device, as recited in claim 6, wherein the holes in said plate member are threaded.

8. The hanging device, as recited in claim 1, wherein the upper mortar line contacting edge of said plate member is a straight edge.

9. The hanging device, as recited in claim 1, wherein the plate member is formed in the shape of a right isosceles triangle wherein the side of said triangle opposing the right angle is the upper mortar line contacting edge of said plate member.

10. The hanging device, as recited in claim 1, wherein there are seven holes formed in said plate member at different distances from said upper mortar line contacting edge.

11. The hanging device, as recited in claim 1, wherein the first and second elongated members are self-tapping threaded members.

12. A method for hanging an object on a brick wall or the like having recessed mortar joints wherein, within the crevice thus formed, an upper brick and a lower brick adjoin mortar at an upper mortar line and a lower mortar line, said method having steps comprising:

a. placing an edge of a plate member in contact with said upper mortar line with the plate member extending downward and outward therefrom;

b. inserting a first threaded elongated member through a first threaded hole formed in said plate member proximate an outer lower edge of said upper brick;

c. inserting a second threaded elongated member through a second threaded hole which is more distant from said edge of said plate member than said first threaded hole so that, upon continuing insertion of said second threaded elongated member, said second threaded elongated member contacts an exposed portion of said lower brick within said crevice;

d. continuing insertion of said second threaded elongated member, thereby pivoting said upper mortar Line contacting edge of said plate member about said upper mortar line until an intermediate location on said first threaded elongated member is forced against the lower outer edge of said upper brick; and e. suspending an object from a threaded elongated member.

* * * * *